United States Patent [19]

Johansson et al.

[11] 4,355,440

[45] Oct. 26, 1982

[54] WALLET THEFT GUARD

[76] Inventors: Francis J. Johansson, 135 Rhodes Dr.; Thomas Christenson, 7 Maple Dr., both of New Hyde Park, N.Y. 11040

[21] Appl. No.: 190,623

[22] Filed: Sep. 25, 1980

Related U.S. Application Data

[63] Continuation-in-part of Ser. No. 51,106, Jun. 2, 1979, Pat. No. 4,241,476.

[51] Int. Cl.[3] ..... A45C 13/18; A45F 5/02

[52] U.S. Cl. ..... 24/3 H; 24/3 R; 150/47

[58] Field of Search ..... 24/3 H, 3 J, 3 L, 3 D, 24/3 E, 3 M, 3 R; 150/47; 2/250

[56] References Cited

U.S. PATENT DOCUMENTS

| | | | |
|---|---|---|---|
| 195,159 | 9/1877 | Peoples | 24/3 J |
| 1,121,465 | 12/1914 | Brown | 150/47 |
| 1,385,443 | 7/1921 | Gross | 2/250 |
| 2,312,100 | 2/1943 | Ketcik, Sr. | 150/47 |
| 2,437,566 | 3/1948 | Stonebraker | 150/47 |
| 2,795,023 | 6/1957 | Howell | 24/3 H |
| 2,891,592 | 6/1959 | Vaca | 150/47 |
| 3,142,876 | 8/1964 | Roberts | 24/3 H |
| 3,462,801 | 8/1969 | Bortle | 24/3 R |
| 4,241,476 | 12/1980 | Christenson et al. | 24/3 H |

FOREIGN PATENT DOCUMENTS

| | | | |
|---|---|---|---|
| 54798 | 7/1920 | Sweden | 24/3 R |

*Primary Examiner*—Paul J. Hirsch
*Attorney, Agent, or Firm*—Leonard W. Suroff

[57] ABSTRACT

A wallet guard is disclosed for use with a wallet and adapted to be used when placed in a pocket having a lower seam and a pair of side seams defining the width thereof to prevent removal therefrom. The wallet guard comprises a base at one end of the guard having a front edge and a rear edge with a support member integrally formed with the base and extending upwardly therefrom and adapted to be slipped into the wallet. A pair of arms extending upwardly from the base is provided with each arm including a lower section integrally coupled to the base and an upper section terminating in a free end. The arms are movable between an open position and closed position. In the open position the distance between the free ends is normally greater than the width of the pocket such that the arms will be biased inwardly by the side seams when inserted into the pocket with the base adjacent the lower seam to provide the upper portion of the pocket in tension. The arms each have an inner surface and an outer surface, and an oppositely disposed front and rear edge intermediate the surfaces. Engaging means is provided in the form of a gripping jaw at the free end of the upper section of each of the arms. Each gripping jaw includes a gripping element having a distal end extending outwardly from the arm, such that the jaws engage the side seams of the pocket in the open position of the wallet guard to prevent removal therefrom, and the arms are narrower than the width of the pocket in the closed position thereof. Gripping means is provided to facilitate closing and opening of the guard and is formed having locking means associated therewith.

13 Claims, 5 Drawing Figures

WALLET THEFT GUARD

CROSS-REFERENCE TO RELATED APPLICATION

This application is a continuation-in-part of our copending applications Ser. No. 051,106, filed June 2, 1979, now U.S. Pat. No. 4,241,476, which entire subject matter of the copening application is incorporated herein by reference as if fully set forth herein.

BACKGROUND OF THE INVENTION

1. Field of the Invention

The present invention relates to a wallet guard for safeguarding and preventing loss thereof that is adapted to partially extend within a card pocket of a conventional billfold or wallet and brought into operational use as desired.

2. Description of the Prior Art

The prior art has appreciated the problem of preventing the theft of a billfold or wallet from a pocket, and particularly a hip pocket, of a pair of slacks. The prior art, as set forth in U.S. Pat. Nos. 1,121,465; 2,437,566; 2,795,023; 2,891,529; 3,142,876; and 3,462,801, embodies various solutions to the problem. It will be clearly understood, by a review of the present invention, that certain drawbacks for the convenient everyday use of prior art type devices have been overcome by the present invention.

OBJECTS OF THE INVENTION

An object of the present invention is to provide an integrally formed wallet theft guard that firmly but removably retains a wallet in a pocket while being simple in construction and cheap to manufacture.

An object of the present invention is to provide a wallet theft guard that may be fabricated from plastic and that may be readily engaged with a wallet and easily inserted within a pocket in its closed position and then brought into its operational open position with a minimum of effort.

Another object of the present invention is to provide a wallet theft guard which enables the wallet to be readily inserted and removed from the pocket during normal use of the guard, while preventing accidental displacement therefrom.

Other objects and advantages of the present invention will become apparent as the disclosure proceeds.

SUMMARY OF THE INVENTION

A wallet guard is disclosed for use with a wallet and adapted to be used when placed in a pocket having a lower seam and a pair of side seams defining the width thereof to prevent removal therefrom. The wallet guard comprises a base at one end of the guard having a front edge and a rear edge with a support member integrally formed with the base and extending upwardly therefrom and adapted to be slipped into the wallet.

A pair of arms extending upwardly from the base is provided with each arm including a lower section integrally coupled to the base and an upper section terminating in a free end. The arms are movable between an open position and a closed position. In the open position the distance between the free ends is normally greater than the width of the pocket such that the arms will be biased inwardly by the side seams when inserted into the pocket with the base adjacent the lower seam to provide the upper portion of the pocket in tension. The arms each have an inner surface and an outer surface, and an oppositely disposed front and rear edge intermediate the surfaces.

Engaging means is formed at the free end of the upper section of each of the arms and may include a gripping jaw or gripping element having a distal end extending outwardly from the arm, such that the jaws engage the side seams of the pocket in the open position of the wallet guard to prevent removal therefrom, and the arms are narrower than the width of the pocket in the closed position thereof.

Accordingly the retaining means is associated with the arms for removably securing the arms at said upper sections thereof in releasably fixed relationship to each other to maintain the closed position when insertion or removal of the wallet guard and wallet with respect to a pocket is desired. In the closed position the wallet guard may be inserted within the pocket of the user and in the open position removal thereof is prevented. To prevent removal the gripping element is formed having a top wall and a side wall. The walls being angularly disposed relative to each other and terminating in the distal end which acts to rub against the side seams of the pocket and essentially engage thereagainst.

The arms extend outwardly from the base in the open position thereof, and are fabricated of a resilient material tending to separate from the closed position to the open position upon release of the retaining means. Hinge means may be interposed between the base and the respective arms.

The retaining means may include a pair of oppositely disposed fingers terminating in a front end and extending inwardly of the upper sections of each of the arms and in alignment with each other, and locking means associated with the front end of each finger so as to readily maintain the arms in the closed position thereof when the arms are compressed towards each other. The locking means includes a protrusion on one of the fingers on one front end and a recess on the other front end. The protrusion being adapted to extend in frictional interlocking relationship within the recess in the closed position and readily separable for movement to its open position. The protrusion includes a slot of a width and depth to receive therein the neck of the opposite arm therein.

There is provided guide means so as to facilitate movement of the arms from the open position to the closed position of the wallet guard. The guide means includes a shoulder that is inclined relative to the associated slot. The other arm of the wallet guard is adapted to readily be seated within the slot in the closed position thereof to maintain interlocking relationship. In addition, gripping means is associated with each of the fingers to facilitate release of the locking means such that the open position is readily obtained. The gripping means may include extensions such that the fingers of the user may be positioned therein to apply a force to readily disengage the locking means.

In addition separating means may be utilized to maintain the arms in the open position thereof when the locking means is not utilized.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
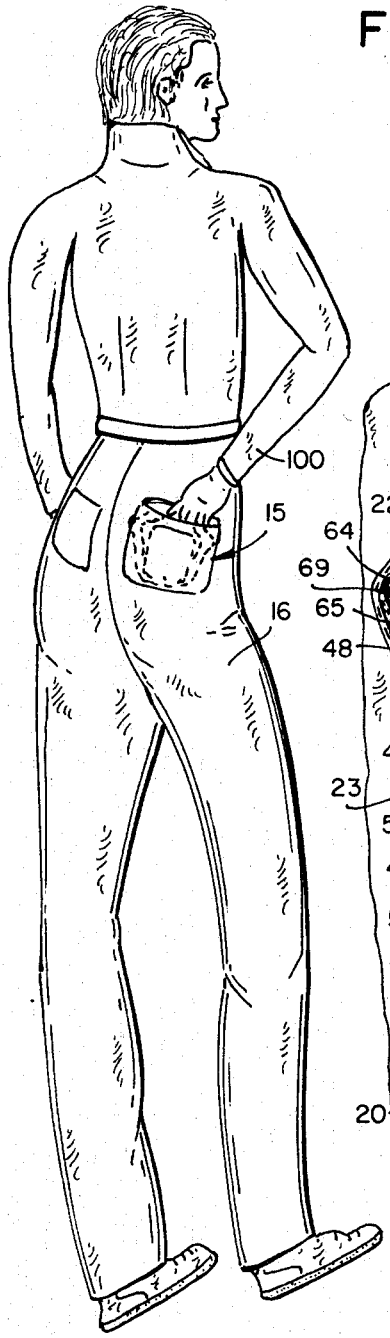
FIG. 1 is a perspective view of the wallet guard in accordance with the present invention, positioned in a pair of men's trousers, in a hip pocket thereof, with the wallet guard illustrated in phantom in its open position.

Referring to the drawings, there is illustrated in FIGS. 1-5 one form of the present invention of a wallet guard 10 to be used with a billfold or wallet 12 having a conventional card recess 14 therein. The wallet 12 is normally stored or placed in a pocket 15 that may be in a garment such as a pair of pants or slacks 16. The pocket 15 includes a lower seam 18 and a pair of side seams 20 defining the width thereof. The pocket 15 includes an upper portion or a corner 22 adjacent to the open end or top 24 of the pocket 15 along each side seam 20.

The wallet guard 10 to be used easily is adapted in the closed position thereof to easily fit into the pocket 15 with the wallet 12 and in the open position prevent unauthorized removal of the wallet 12 from within the pocket 15. The wallet guard 10 includes a frame 23 that may be comprised of a base 25 having a front edge 26 and rear edge 27. The length of the base 25 is narrower than the lower seam 18 such that it can easily slide into the pocket 15 at its open end 24.

Figure 4:
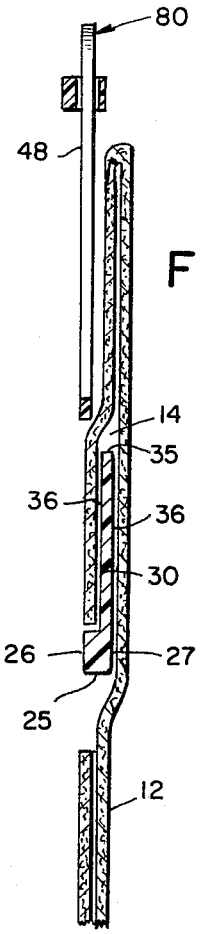
FIG. 4 is a sectional view taken along lines 4—4 of FIG. 3 illustrating the engaging means.

The frame 23 has a support member 30 integrally formed with the base 25 and extending upwardly therefrom and adapted to be slipped into the recess 14 therein, as illustrated in FIG. 4. The support member 30 may have tapered sides 34 and terminating in an upper end 35. A pair of walls 36 extends intermediate the sides 34 and upper end 35.

Figure 2:
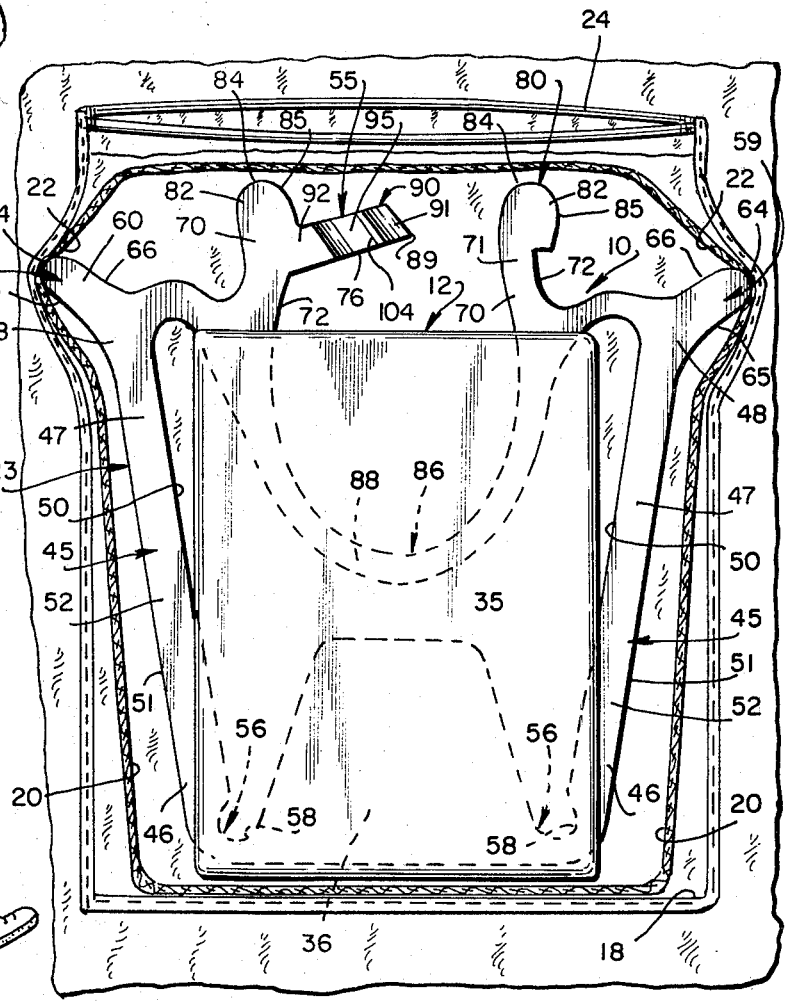
FIG. 2 is a front plan view of the wallet guard positioned in a pocket and illustrated in its open position therein.
Figure 3:
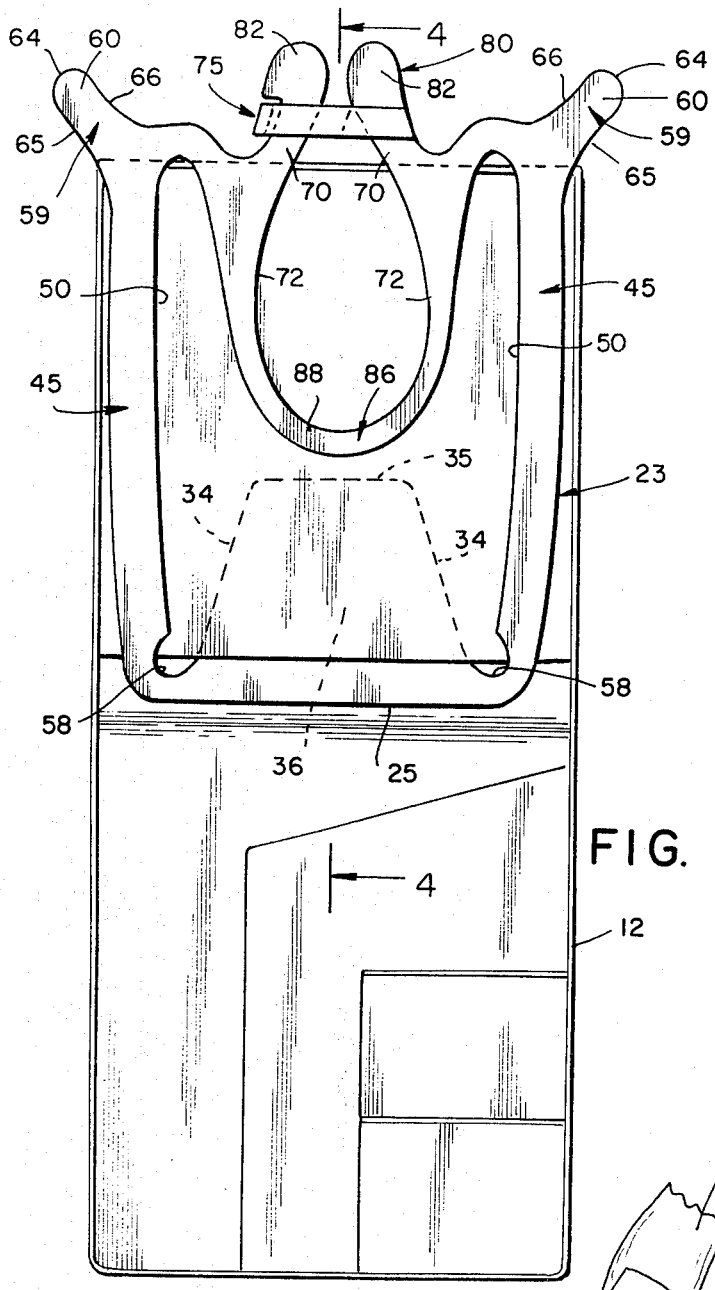
FIG. 3 is a front plan view of the wallet guard in its closed position illustrating the conventional wallet in relation thereto.
Figure 5:
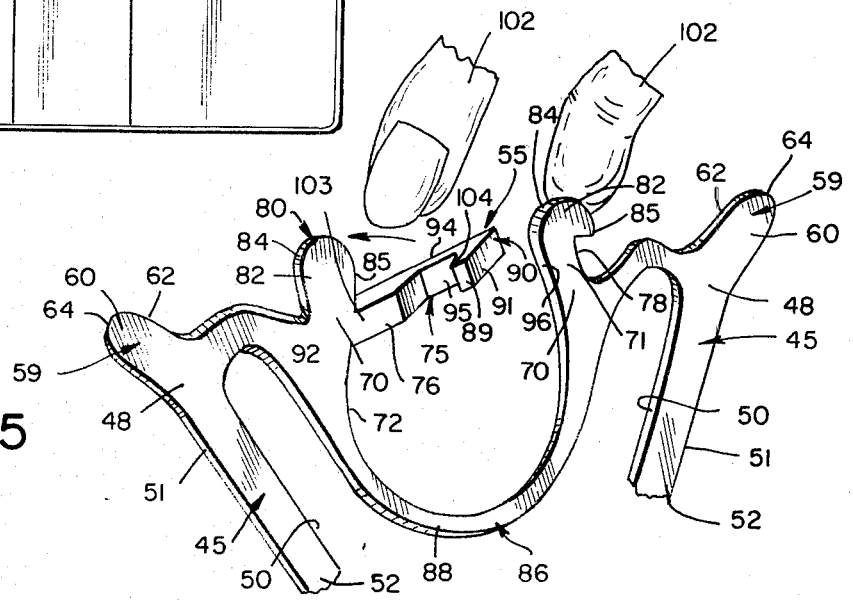
FIG. 5 is an enlarged fragmentary view of the locking means in accordance with the invention.

The guard 10 includes a pair of arms 45 extending upwardly from the base 25. Each arm includes a lower section 46 and an upper section 47 integrally coupled to the base 25. Each upper section 47 terminates in a free end 48. The arms 45 are movable between an open position as illustrated in FIGS. 2 and 5, and a closed position as illustrated in FIG. 3, whereby in the open position the distance between the free ends 48 is normally greater than the width of the pocket 12 such that the arms 45 will be biased inwardly by the side seams 20 when inserted into the pocket 12 with the base 25 adjacent the lower seam 18 to provide the upper portion 22 of the pocket 12 in tension. The arms 45 each have an inner surface 50 and an outer surface 51, and oppositely disposed front edge 52 and rear edge 53 intermediate the surfaces 50 and 51. The respective front and rear edges 26 and 27 of the base 25 and the front and rear edges 52 and 53 of the arms 45 may extend in the same common plane.

The arms 45 extend outwardly from the base 25 in the open position thereof, and are fabricated of a resilient material, such as plastic, tending to separate from the closed position to the open position upon release of the retaining means 55 hereinafter described. To accomplish this there is provided hinge means 56 extending between each arm 45 and the base 25 so as to permit angular movement of each arm 45 independently relative to the base 25. As illustrated in FIG. 2, at the junction of each arm 45 and the base 25 there may be provided an indentation 58 such that in moulding of the guard 10 an initial tension is provided such that the normal position of the arms 45 is such as to be angularly positioned relative to the base 25. In this manner the open position of the arms 45 is the normal position thereof.

To maintain the guard 10 in non-removable condition in the open position thereof, there is provided engaging means 59 which may be in the form of a gripping jaw 60 formed at the free end 48 of the upper section 47 of each arm 45. Each gripping jaw 60 includes a gripping element 62 having a distal end 64 extending outwardly from the arm 45, such that the jaws 60 engage the side seams 20 of the pocket 12 in the open position of the wallet guard 10 to prevent removal therefrom. The arms 45 are narrower than the width of the pocket in the closed position thereof.

Each gripping element 62 is formed having an end wall 65 and an end wall 66. The walls 65 and 66 are contoured or angularly disposed relative to each other and terminate in the distal end 64. Accordingly each gripping element 62 includes a configuration formed by the walls 65 and 66.

The gripping element 62 is shaped to in effect act as an anchor such that if an attempt is made to remove the wallet 12, the jaws 60 will reach into and be caught at each corner 22 of the pocket 15. As illustrated in FIG. 1, the distal end 64 of each jaw 60 is pointed and formed by the end walls 65 and 66 so as to engage the side seams 20 and apply an outwardly directed force.

The retaining means 55 is associated with the arms 55 for removably securing the arms 45 at the upper sections 47 thereof in releasably fixed relationship to each other to maintain the closed position when insertion or removal of the wallet guard 10 and wallet 12 with respect to the pocket 15 is desired, such that in the closed position of the wallet guard 10 it may be inserted within the pocket 15 of the user and in the open position removal thereof is prevented. The retaining means 55 includes a pair of oppositely disposed fingers 70 terminating in a front end 72 and extending inwardly of the upper sections 47 of each arm 45 and in alignment with each other. The fingers 70 may be positioned in spaced relationship to the free end 48 of each arm 45, as illustrated in FIGS. 2 and 5.

The retaining means 55 further includes locking means 75 that is associated with the front end 72 of each finger 70 so as to readily maintain the arms 45 in the closed position thereof when the arms 45 are compressed towards each other and lock together. The locking means 75 includes a protrusion 76 on one of the fingers 70 on one front end 72 and a recess 78 on the other front end 72. The protrusion 76 is adapted to extend in frictional interlocking relationship within the recess 78 in the closed position and readily separable for movement to its open position.

To facilitate movement of the front ends 72 from the open to closed position of the guard 10, there is provided gripping means 80. The gripping means 80 includes an extension 82 having a top end 84 and a front face 85 on each of the fingers 70 extending upwardly therefrom. The locking means 75 may be contained on the front face 85 of the gripping means 80. The front face 85 may coincide with the front end 72 of each finger 70 or spaced therefrom, as illustrated in the embodiment illustrated in FIG. 5.

In addition, there is provided separating means 86 associated with each of the fingers 70 to facilitate release of the gripping means 80 for releasing of the locking means 75 such that the open position is readily obtained and maintained. The separating means 86 may include a contoured rib 88 extending between the fingers 70 and illustrated in FIGS. 2 and 5 in its normal position. The rib 88 is flexible and in the position illustrated in FIG. 3 places the arms 45 under tension. The locking means 75 maintains the arms 45 in the closed position and the guard 10 is adaptable to be inserted and removed from the pocket 15. The rib 88 is designed such that upon disengagement of the locking means 75 the arms 45 automatically extend to the open or operative position of the guard 10. The thickness or contour of the rib 88 may be varied depending upon the spring tension desired to be obtained in the guard 10.

The guard 10 is readily used and may be fabricated from a plastic material as by moulding. The construction is such as to facilitate easy use of the guard 10. In addition, the locking means 75 facilitates the arms 45 being readily held together when the closed position is utilized either in the insertion or removal of the guard 10 and wallet 12 into and out of the pocket 15. The gripping means 80 is used by the user to close the guard 10 by means of the extensions or members 82 that may be integrally formed with the fingers 70. The thickness of the guard is such that it takes up a minimal space in the pocket 15. The gripping means 80 is also used to open or disengage the locking means 75 as hereinafter described.

The locking means 75 is designed to facilitate quick assembly of engagement of the respective components thereof and at the same time release of the locking means 75 while in the pocket 15 of the user. The protrusion 76 has a head 89 with guide means 90 associated therewith. The guide means 90 include a beveled edge or shoulder 91. The protrusion 76 has a front face 92 and a rear face 94. The shoulder 91 is inclined inwardly from the rear face 94 to the front face 92. A well or slot 95 is contained inwardly of the front face 92 and adjacent to the shoulder 91.

The finger 70 has a neck portion 71, defined by the width between its front end 72 and the rear end 96 such that the neck 71 is adapted to be seated within the slot 95. The guide means 90 is designed to assure the user while using his or her hand 100 that the guard 10 will move into its locking position when removal of the wallet 12 is desired. The protrusion 76 and opposite finger 70 are substantially in the same horizontal plane as illustrated in FIG. 4. In this manner the rear end 96 first abuts against the shoulder 91 when the user manipulates the gripping means 80 by his or her fingers 102 as illustrated in FIG. 5. The rear end 96 rides against the shoulder 91 and is flexible enough to move inwardly in the direction of arrow 103 until the front end 72 passes wall 104 of the slot 95. At this point the right arm 45 snaps into place and is seated within the slot 95. The separating means 86 provides the outward force which aids in maintaining the front end 72 in abutting engagement with the wall 104. To disengage the locking means 75 from the position disclosed in FIG. 3 to that disclosed in FIGS. 2 and 5 the user can use his or her fingers 102 and apply forces in opposite direction to each member 82 such that the arm 45 within the slot 95 will snap out and automatically return to the open position as illustrated in FIGS. 2 and 5. The resiliency of the plastic material used and particularly in the separating means 86 provides the movement desired.

Although an illustrative embodiment of the invention has been described in detail herein with reference to the accompanying drawings, it is to be understood that the invention is not limited to the precise embodiment, and that various changes and modifications may be effected therein without departing from the scope or spirit of the invention.

What is claimed is:

1. A wallet guard for use with a wallet and adapted to be used when placed in a pocket having a lower seam and a pair of side seams defining the width thereof to prevent removal therefrom, the wallet guard comprising:

A. a frame having a base with a pair of arms extending upwardly from said base, each said arm including a lower section integrally coupled to said base and an upper section terminating in a free end, said arms movable between an open position and a closed position, whereby in the open position the distance between said free ends is normally greater than the width of the pocket such that said arms will be biased inwardly by the side seams when inserted into the pocket with the base adjacent the lower seam to provide the upper portion of the pocket in tension, B. engaging means including a gripping jaw formed at said free end of said upper section of each of said arms, each said gripping jaw having a distal end extending outwardly from said arm, such that said jaws engage the side seams of the pocket in the open position of the wallet guard to prevent removal therefrom, and said arms are narrower than the width of the pocket in the closed position thereof, C. retaining means associated with said arms for removably securing said arms at said upper sections thereof in releasably fixed relationship to each other to maintain the closed position when insertion or removal of the wallet guard and wallet with respect to a pocket is desired, such that in the closed position of the wallet guard it may be inserted within the pocket of the user and in the open position removal thereof is prevented, D. locking means associated with said retaining means so as to readily maintain said arms in the closed position thereof when said arms are compressed towards each other a defined distance, E. said locking means includes a protrusion having a slot therein extending from one of said arms, and a neck on the other of said arms adapted to extend in frictional interlocking relationship within said slot in the closed position and readily separable for movement to its open position, and F. guide means at one end of said protrusion for guiding said neck along said protrusion until said slot is reached and said neck is received therein for said interlocking relationship.

2. A wallet guard as in claim 1, wherein each said gripping jaw includes a gripping element which is formed having a top wall and a side wall, said walls being angularly disposed relative to each other and terminating in said distal end.

3. A wallet guard as in claim 1, wherein said guide means includes a shoulder angularly disposed relative to said protrusion for engaging said neck and deflecting said arm until said neck is seated within said slot.

4. A wallet guard as in claim 1, wherein said base and said arms each have a front edge and a rear edge with the respective edges of said base and said arms extending in the same common plane.

5. A wallet guard as in claim 1, wherein said arms extend outwardly from said base in the open position thereof, and are fabricated of a resilient material tending to separate from the closed position to the open position upon release of said retaining means.

6. A wallet guard as in claim 1, wherein said retaining means includes:

a. a pair of oppositely disposed fingers terminating in a front end and extending inwardly of said upper sections of each of said arms and in alignment with each other, and b. said locking means is associated with said front end of each said finger so as to readily maintain said arms in the closed position thereof when said arms are compressed towards each other.

7. A wallet guard as in claim 6, wherein said fingers are positioned at substantially said free end of said arms.

8. A wallet guard as in claim 6, including gripping means associated with each of said arms to facilitate release of said locking means such that the open position is readily obtained.

9. A wallet guard as in claim 8, wherein said gripping means includes an extension having a top end and a front face on each of said fingers extending upwardly therefrom.

10. A wallet guard as in claim 3, wherein said protrusion includes a front face and a rear face and said shoulder is inclined inwardly from said rear face to said front face.

11. A wallet guard as in claim 9, wherein said slot is contained inwardly of said front face.

12. A wallet guard as in claim 1, including separating means associated with said arms, said separating means including a rib extending between said arms for providing an outwardly directed force so as to aid in retaining said arms in the open position thereof.

13. A wallet guard as in claim 1, including hinge means extending between each said arm and said base so as to permit angular movement of each said arm independently relative to said base.

* * * * *